US005161259A

United States Patent [19]

Shorts

[11] Patent Number: 5,161,259

[45] Date of Patent: Nov. 10, 1992

[54] CAP FLAP

[76] Inventor: Timothy W. Shorts, 17113 Thom Fox Ave., Poolesville, Md. 20837

[21] Appl. No.: 713,106

[22] Filed: Jun. 11, 1991

[51] Int. Cl.[5] ..... A42B 1/06

[52] U.S. Cl. ..... 2/199; 2/171; 2/195; 2/198; 2/206

[58] Field of Search ..... 2/171, 174, 175, 181, 2/181.4, 185 R, 195, 196, 198, 199, 206, 209.1, DIG. 11

[56] References Cited

U.S. PATENT DOCUMENTS

| | | | |
|---|---|---|---|
| 202,262 | 4/1878 | Isidor | 2/199 |
| 270,242 | 1/1883 | Mitchell | 2/199 |
| 805,052 | 11/1905 | Brooks | 2/206 |
| 822,986 | 6/1906 | Rochet | 2/199 |
| 1,481,541 | 1/1924 | Douglas | 2/198 |
| 1,505,183 | 8/1924 | Zucker | 2/195 |
| 2,184,240 | 12/1939 | McInnis | 2/174 |
| 2,230,805 | 2/1941 | Levy | 2/195 |
| 2,578,219 | 12/1951 | Berry | 2/199 |
| 2,897,510 | 8/1959 | Forbes-Robinson | 2/195 |
| 2,986,741 | 6/1961 | Brasington | 2/172 |
| 4,853,974 | 8/1989 | Olim | 2/206 |
| 4,914,754 | 4/1990 | Ruth | 2/171 |
| 4,980,928 | 1/1991 | Ellis | 2/199 |
| 5,025,507 | 6/1991 | Kirby | 2/171 |
| 5,035,006 | 7/1991 | Hetz | 2/206 |
| 5,046,195 | 9/1991 | Koritan | 2/185 R |
| 5,058,211 | 10/1991 | Hanks | 2/DIG. 11 |

FOREIGN PATENT DOCUMENTS

| | | | |
|---|---|---|---|
| 781682 | 5/1935 | France | 2/198 |
| 1013878 | 5/1952 | France | 2/198 |
| 1377550 | 2/1965 | France | 2/199 |
| 330681 | 7/1958 | Switzerland | 2/206 |

*Primary Examiner*—Werner H. Schroeder
*Assistant Examiner*—Diana L. Biefeld
*Attorney, Agent, or Firm*—John P. Halvonick

[57] ABSTRACT

The invention relates to a neck covering protective garment that comes as a two piece garment for wearing around the head and neck. The rear piece covers the back of the neck from sunburn and is attached to the rear adjustment strap of a standard baseball cap. The rear piece is readily detachable from the baseball cap and uses an upper strap that goes around the bill of the cap and a second attaching portion for attaching the rear piece to the ball cap.

10 Claims, 1 Drawing Sheet

CAP FLAP

BACKGROUND OF THE INVENTION

1. Field of the Invention

The invention relates to the field of caps and coverings to protect the neck from sun. Specifically, the clothing item is a two piece article with a neck covering cape and standard type baseball cap that is attached to it.

2. Description of the Prior Art

While there are clothing pieces that are designed to cover the neck from sunburn, none that applicant is aware of are attached to a standard baseball type cap in this particular way.

SUMMARY OF THE INVENTION

The device relates to a two piece garment which is designed to protect the neck from sunburn and is attachable to the back adjusting strap of the standard baseball type cap. A cape like portion utilizes an upper band that encircles the top part of the cap and is attachable by VELCRO or other means. A second attaching means is centered at the top of the cape and is attached directly to the back strap itself.

It is an objective of the invention to provide a cape like attachment to baseball type caps in order to protect the neck from sunburn.

Another objective is to provide a covering for the neck that can be easily attached and removed when not needed.

Other advantages will be apparent once the invention is shown and described.

DESCRIPTION OF THE PREFERRED EMBODIMENT

Figure 1:
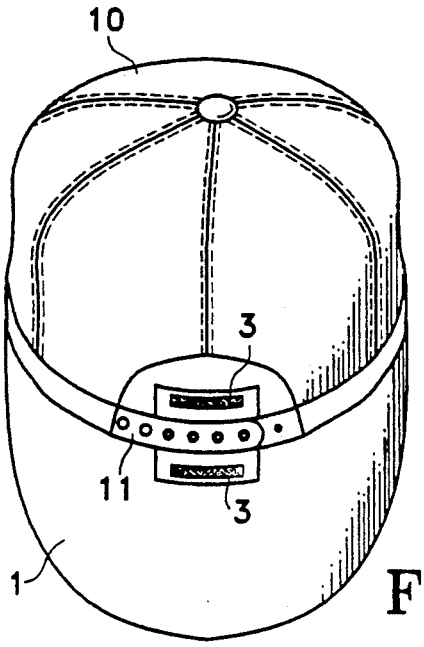
FIG. 1 shows the overall construction of the clothing article.
Figure 4:
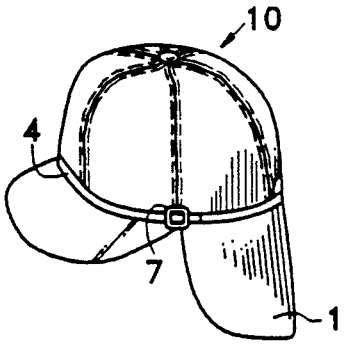
FIG. 4 shows positioning of the buckle means of the upper strap at the side of the head.
Figure 2:
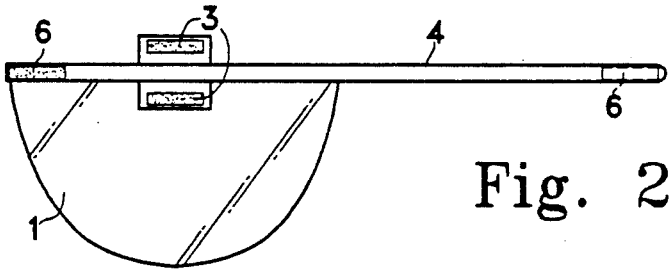
FIG. 2 shows alternate means of attaching using VELCRO for both upper and middle strap attaching portions.
Figure 3:
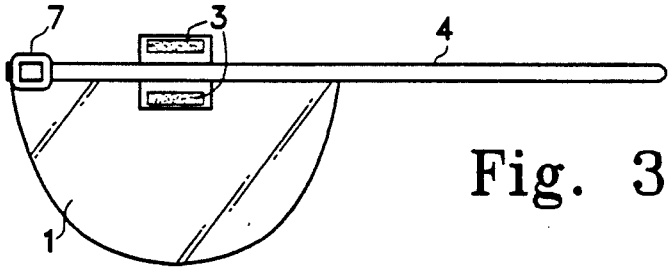
FIG. 3 shows middle strap portion using VELCRO attaching means and buckle connection at upper strap ends.
Figure 5:
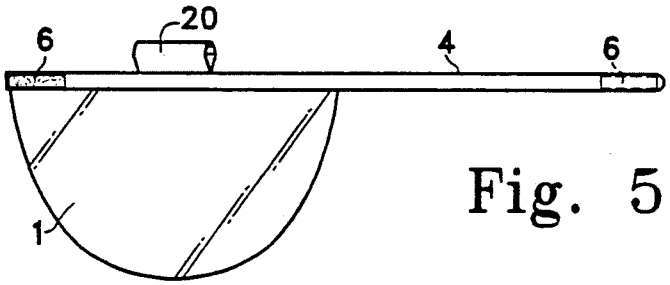
FIG. 5 shows alternate loop construction of attachment strap.

The device is a two piece garment that is designed to be worn on the head and neck on the golf course, jogging course, beach, leisure area, etc. to protect the neck and shoulders from the effects of the sun. One of the pieces is a standard baseball type cap 10 of the kind commonly worn nowadays. The other piece 1 is the neck covering piece which resembles a cape and is attachable to the back adjustment strap 11 of the cap itself.

By "ordinary baseball-type cap" it is meant that kind of cap that generally has a strap 11 on the back which serves as an adjustment for the hat band. The adjustment strap often consists of one end with a series of nubs and the other with a series of holes that the nubs can be secured into.

The neck covering piece 1 may be of any material that is resistant to the effects of the sun, including cotton, nylon, rayon, and other materials. The piece may resemble a cape or other covering that is suitable enough to cover the neck, shoulders and/or back of the wearer.

At the top of the neck piece is a strap 4 (designated: "upper strap portion") that goes along the top edge of this covering piece and has ends 6 which are attachable to each other. These ends may comprise: VELCRO mating pieces 6; buckle and clasp 7; button and button hole 8; or other attaching means. This upper strap portion goes around the front of the cap and is secured around it by attaching the two ends of the strap to themselves.

These pieces would then rest at the back, sides or front of the cap. It would probably be best to attach the ends of the upper strap at the front of the cap and then turn them around so they are in place at the back of the cap (at the back of the head) for appearance sake.

Another attaching means 3 is connected to the top part of the covering piece and about near the middle of the top edge (designated: attachment strap). This attaching means is designed to attach to the adjusting strap 11 of the cap located at the back of the cap. One type of attaching means could be a loop made of cloth or other material. This loop 20 would be made integral with the top edge of the covering piece and the adjusting strap would slide inside the loop.

Alternately the attaching means may be made attachable to itself and can be placed around the back adjustment strap of the cap and secured to the strap by being attached to itself. For example: the middle strap can have VELCRO mating pieces spaced along its length, or, a button and button hole spaced along its length. Other means of attachment spaced along the length of the middle strap are also possible so that they are able to attach the middle strap around the adjustment strap of the cap.

I claim:

1. A two piece garment for covering the head and neck of the wearer from the effects of the sun comprising:

a) a cap portion comprising a head covering portion and a bill portion extending from said head covering portion and an adjustment strap attached to said head covering portion and on a side opposite said bill portion, said adjustment strap capable of being varied in length to fit the head of said wearer, and b) a neck covering piece having a top edge and made of a material suitable for protecting the neck of the wearer from the effects of the sun and an upper strap attached along said top edge of said neck covering piece, said upper strap having ends free of said top edge, each of said ends having means for attaching said ends to one another to secure said neck covering piece around said cap, and an attachment strap in connection with said top edge for attaching said neck covering piece to said adjustment strap, said attachment strap having adjoining hook and loop material portions, said hook and loop material portions complementary to one another so that said attachment strap may be secured around said adjustment strap.

2. The garment of claim 1 where said attachment strap is attached to near the middle of said top edge portion of said neck covering piece.

3. The garment of claim 2 wherein said means for attaching said upper strap ends comprises a buckle and clasp.

4. The garment of claim 2 wherein said means for attaching said upper strap ends comprises a button and corresponding button hole.

5. The garment of claim 2 wherein said means for attaching said upper strap ends comprises complementary snaps capable of attachment to one another.

6. A two piece garment for covering the head and neck of the wearer from the effects of the sun comprising:

a) a cap portion comprising a head covering portion and a bill portion extending from said head covering portion and an adjustment strap attached to said head covering portion and on a side opposite said bill portion, said adjustment strap capable of being varied in length to fit the head of said wearer, and b) a neck covering piece having a top edge and made of a material suitable for protecting the neck of the wearer from the effects of the sun and an upper strap attached along said top edge of said neck covering piece, said upper strap having ends free of said top edge, each of said ends having means for attaching said ends to one another to secure said neck covering piece around said cap, and a loop portion attached to near the middle of said top edge portion of said neck covering piece, so that said adjustment strap may be placed through said loop portion and thereby attached to said neck covering piece.

7. The garment of claim 6 wherein means for attaching said upper strap ends comprise hook and loop material portions, said material portions complementary to one another and capable of attachment to one another.

8. The garment of claim 6 wherein said means for attaching said upper strap ends comprises a buckle and clasp.

9. The garment of claim 6 wherein said means for attaching said upper strap ends comprises a button and corresponding button hole.

10. The garment of claim 6 wherein said means for attaching said upper strap ends comprises complementary snaps capable of attachment to one another.

* * * * *